US012193590B2

(12) United States Patent
Ovist et al.

(10) Patent No.: US 12,193,590 B2
(45) **Date of Patent: *Jan. 14, 2025**

(54) COUPLER SYSTEM

(71) Applicant: Grovist Innovations, LLC, Depoe Bay, OR (US)

(72) Inventors: Vince Ovist, Depoe Bay, OR (US); William T. Grohs, Eugene, OR (US)

(73) Assignee: Grovist Innovations, LLC, Depoe Bay, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/352,206

(22) Filed: Jul. 13, 2023

(65) Prior Publication Data

US 2023/0355023 A1 Nov. 9, 2023

Related U.S. Application Data

(63) Continuation of application No. 16/997,883, filed on Aug. 19, 2020, now abandoned, which is a (Continued)

(51) Int. Cl.
*A47H 1/142* (2006.01)
*A47H 1/02* (2006.01)

(Continued)

(52) U.S. Cl.
CPC ..... *A47H 1/142* (2013.01); *A47H 1/02* (2013.01); *A47H 1/04* (2013.01); *A47H 1/102* (2013.01);

(Continued)

(58) Field of Classification Search
CPC ..... Y10T 403/32041; Y10T 403/32565; Y10T 403/32573; Y10T 403/34; Y10T 403/341;

(Continued)

(56) References Cited

U.S. PATENT DOCUMENTS 470,211 A 3/1892 Philips
3,286,391 A 11/1966 Mengeringhausen (Continued)

FOREIGN PATENT DOCUMENTS

DE 3035698 A1 4/1982
DE 8333865 U1 3/1987

(Continued)

OTHER PUBLICATIONS

Amiri, Nahid, Examiner, Commissioner for Patents, "International Preliminary Report on Patentability" in connection with related International Application No. PCT/US2011/039333, dated May 29, 2012, 8 pages.

(Continued)

*Primary Examiner* — Joshua T Kennedy
(74) *Attorney, Agent, or Firm* — Kolisch Hartwell, P.C.

(57) ABSTRACT

A coupler system for connecting elongate, horizontally disposed rods to vertical supports includes a top-cap component for attaching to the top of a vertical support. The top-cap support includes a body with plural cavities, and at least one ball-cap component for attaching to an end of a rod. The ball-cap component includes a ball region that fits within one of the plural cavities. The body may be formed with four plural cavities, each having beveled edges. The ball-cap component may include a ball region, a neck region, and an angled region located adjacent the neck region and away from the ball region. The top-cap and ball-cap components may include insertion regions with opposing sets of ribs. The coupler system may further include a cover component, and the body may be formed with a central hole for receiving a fastener that secures the cover component to the top-cap component.

13 Claims, 2 Drawing Sheets

Related U.S. Application Data continuation of application No. 16/378,416, filed on Apr. 8, 2019, now Pat. No. 10,750,895, which is a continuation of application No. 14/967,138, filed on Dec. 11, 2015, now Pat. No. 10,251,505, which is a continuation of application No. 13/154,340, filed on Jun. 6, 2011, now Pat. No. 9,211,027.

(60) Provisional application No. 61/351,799, filed on Jun. 4, 2010.

(51) Int. Cl.

| | |
|---|---|
| ***A47H 1/04*** | (2006.01) |
| ***A47H 1/102*** | (2006.01) |
| ***A47H 21/00*** | (2006.01) |
| *E04B 1/58* | (2006.01) |

(52) U.S. Cl.

CPC ..... *A47H 21/00* (2013.01); *A47H 2001/021* (2013.01); *E04B 1/5843* (2013.01); *Y10T 24/45267* (2015.01); *Y10T 24/45984* (2015.01); *Y10T 29/49826* (2015.01); *Y10T 403/34* (2015.01)

(58) Field of Classification Search

CPC . Y10T 403/343; Y10T 403/346; Y10T 24/34; Y10T 24/45267; Y10T 24/45984; A47H 1/04; A47H 1/10; A47H 1/14; A47H 1/102; A47H 1/104; A47H 1/144; E04B 1/1906; E04B 1/1909; E04B 1/5843; E04B 2001/2406; F16G 11/108; A47B 47/0016

See application file for complete search history.

(56) References Cited

U.S. PATENT DOCUMENTS

| | | | | |
|---|---|---|---|---|
| 3,789,562 | A | 2/1974 | De Chicchis et al. | |
| 4,094,417 | A | 6/1978 | Cairnes et al. | |
| 4,480,418 | A * | 11/1984 | Ventrella | E04B 1/1906 403/171 |
| 4,627,210 | A * | 12/1986 | Beaulieu | A45B 25/10 135/147 |
| 4,678,360 | A | 7/1987 | Miller | |
| 4,766,712 | A | 8/1988 | Hale | |
| 4,951,440 | A * | 8/1990 | Staeger | E04B 1/1909 403/171 |
| 4,974,986 | A * | 12/1990 | Cook | F16B 7/04 403/171 |
| 5,101,607 | A | 4/1992 | Staeger | |
| 5,111,631 | A | 5/1992 | Flood et al. | |
| 5,203,134 | A | 4/1993 | Sorenson et al. | |
| 5,291,708 | A * | 3/1994 | Johnson | E02D 27/01 47/33 |
| 5,308,061 | A | 5/1994 | Bernhardt | |
| 5,356,234 | A * | 10/1994 | Vangool | E04B 1/1903 403/171 |
| 5,626,434 | A * | 5/1997 | Cook | E04B 1/1903 403/171 |
| 5,667,326 | A * | 9/1997 | McGaffigan | A63H 33/042 403/348 |
| 5,802,798 | A | 9/1998 | Martens | |
| 6,223,917 | B1 | 5/2001 | Bruder | |
| 6,238,124 | B1 | 5/2001 | Merlo | |
| 6,341,566 | B1 | 1/2002 | Hwang | |
| 6,397,537 | B2 | 6/2002 | Auer et al. | |
| 6,475,117 | B1 | 11/2002 | Berglund et al. | |
| 6,919,501 | B2 | 7/2005 | Burton | |
| 6,996,946 | B1 | 2/2006 | Cazzolaro | |
| 7,096,637 | B2 | 8/2006 | McMillan | |
| 7,097,146 | B2 | 8/2006 | Tsai | |
| 7,637,686 | B2 | 12/2009 | Wood et al. | |
| 7,780,371 | B2 | 8/2010 | Daubner | |
| 7,841,572 | B2 | 11/2010 | Chen et al. | |
| 9,211,027 | B2 | 12/2015 | Ovist et al. | |
| 10,251,505 | B2 | 4/2019 | Ovist et al. | |
| 10,750,895 | B2 | 8/2020 | Ovist et al. | |
| 2002/0059770 | A1 * | 5/2002 | Fritsche | G09F 15/0062 52/645 |
| 2006/0278777 | A1 | 12/2006 | Atkinson et al. | |
| 2007/0125033 | A1 | 7/2007 | Stephan et al. | |
| 2019/0154079 | A1 * | 5/2019 | Shapiro | F16B 7/185 |
| 2021/0204740 | A1 | 7/2021 | Ovist et al. | |

FOREIGN PATENT DOCUMENTS

| | | | |
|---|---|---|---|
| DE | 3800547 | A1 | 7/1989 |
| FR | 2690190 | A1 | 10/1993 |

OTHER PUBLICATIONS

Copenheaver, Blaine R., Examiner, Commissioner for Patents, "International Search Report" in connection with related International Application No. PCT/US2011/039333, dated Nov. 14, 2011, 2 pages.

Copenheaver, Blaine R., Examiner, Commissioner for Patents, "Written Opinion of the International Searching Authority" in connection with related International Application No. PCT/US2011/039333, dated Nov. 14, 2011, 4 pages.

Côté, Alexis, Examiner, Canadian Intellectual Property Office, "Office Action" in connection with related Canadian Patent Application No. 2801766, dated Dec. 16, 2013, 2 pages.

Côté, Alexis, Examiner, Canadian Intellectual Property Office, "Examination Search Report" in connection with related Canadian Patent Application No. 2801766, dated Aug. 18, 2015, 3 pages.

Côté, Alexis, Examiner, Canadian Intellectual Property Office, "Examination Search Report" in connection with related Canadian Patent Application No. 2801766, dated May 9, 2016, 3 pages.

Côté, Alexis, Examiner, Canadian Intellectual Property Office, "Examination Search Report" in connection with related Canadian Patent Application No. 2979913, dated Oct. 23, 2017, 3 pages.

Stern, Claudio, Examiner, European Patent Office, "Extended European Search Report" in connection with related European Patent Application No. 11790549.7, dated Sep. 29, 2016, 7 pages.

Stern, Claudio, Examiner, European Patent Office, "Communication pursuant to Article 94(3) EPC" in connection with related European Patent Application No. 11790549.7, dated Jul. 3, 2017, 5 pages.

Stern, Claudio, Examiner, European Patent Office, "Communication pursuant to Article 94(3) EPC" in connection with related European Patent Application No. 11790549.7, dated Apr. 5, 2018, 5 pages.

Tänzler, Ansgar, Examiner, European Patent Office, "Extended European Search Report" in connection related European Patent Application No. 19171905.3-1002, dated Jul. 31, 2019, 9 pages.

* cited by examiner

COUPLER SYSTEM

CROSS-REFERENCE TO RELATED APPLICATIONS

This application is a continuation of U.S. patent application Ser. No. 16/997,883, filed Aug. 19, 2020; which application is a continuation of U.S. patent application Ser. No. 16/378,416, filed Apr. 8, 2019, now U.S. Pat. No. 10,750,895; which application is a continuation of U.S. patent application Ser. No. 14/967,138, filed Dec. 11, 2015, now U.S. Pat. No. 10,251,505, and entitled COUPLER SYSTEM, which application is a continuation of U.S. patent application Ser. No. 13/154,340, filed Jun. 6, 2011, now U.S. Pat. No. 9,211,027, and entitled "COUPLER SYSTEM," which claims priority to U.S. Provisional Patent Application Ser. No. 61/351,799, filed Jun. 4, 2010 also entitled "COUPLER SYSTEM", the disclosures of which are herein incorporated by reference.

BACKGROUND

The general field of invention relates to couplers for hanging horizontal rods, such as a drape rod. Conventional, so-called hook-and-slot systems include vertically-positioned aluminum poles with slots formed in top regions for receiving hooks that extend from the ends of horizontally-positioned rods.

Limitations with these conventional designs include the requirement that the hook components need to engage the slot components at an angle of close to 90 degrees to make the desired connection. Also, the edge of the metal hook causes wear against the slots formed in the vertically-positioned aluminum poles. Over time and after use, the slots become enlarged which causes excessive and undesired play between the hook and the slot, making the system less effective.

DESCRIPTION

Preliminarily, the coupler system of the present invention can be used for any suitable application. One of those applications is the so-called drape-and-rod industry, where horizontally-disposed poles or rods are placed between, and at the top of, vertically-positioned support poles or rods. Drapes are hung from the horizontally-positioned poles to form desired partitions. Configurations of these horizontally-positioned and vertically-positioned poles are used to form trade show booths, displays and other upright systems. The coupler of the present invention can be used in the drape-and-rod industry to provide an improved system for making desired configurations of the horizontally-positioned and vertically-positioned poles. Other applications of the coupler system of the present invention are for temporary barricades and stanchions.

Figure 1:
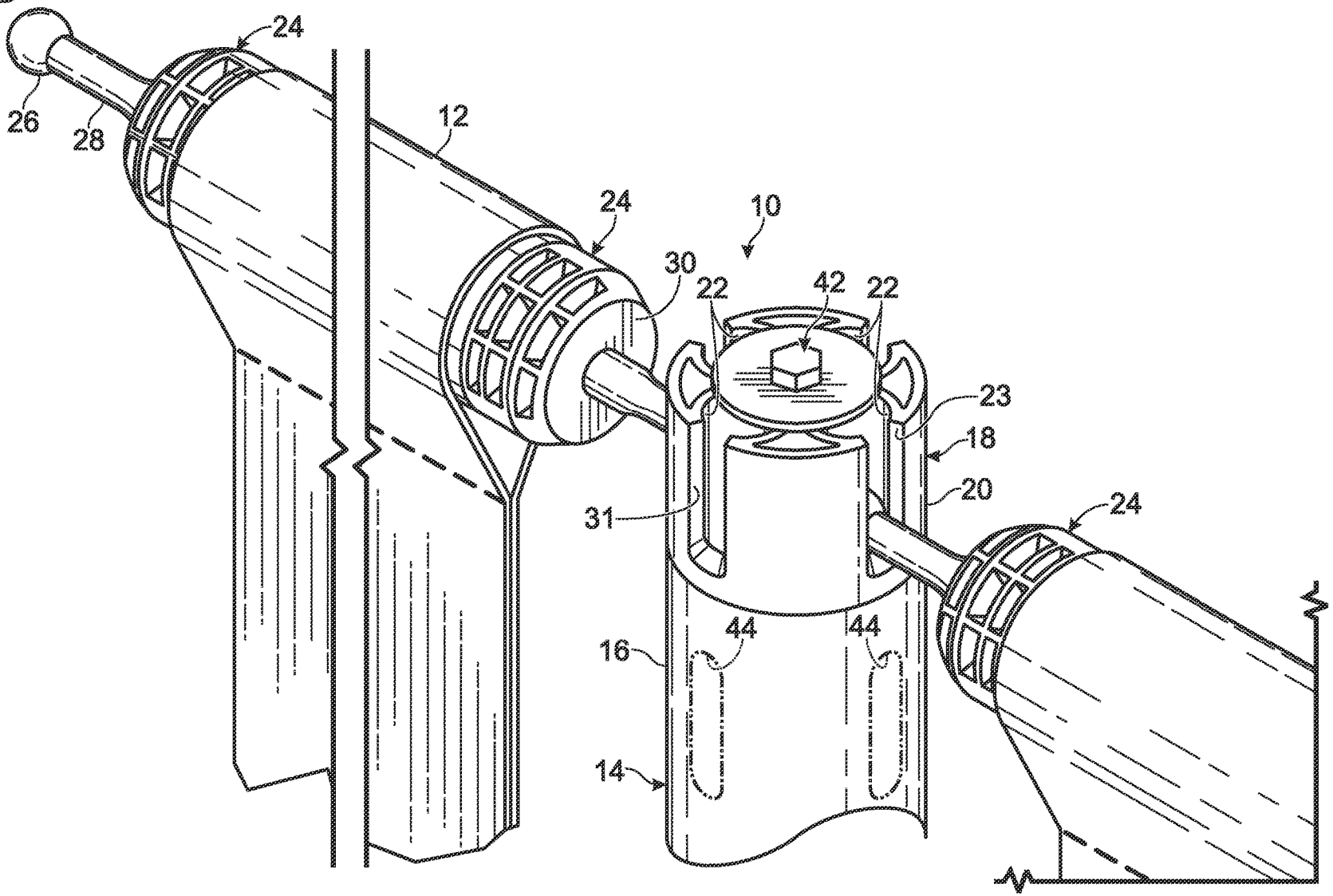
FIG. 1 is a fragmentary, isometric view of a coupler system connected to a corresponding vertical support and rods, and showing a top-cap component and plural ball-cap components illustrating features of the present invention.

Referring to FIG. 1, shown at 10 is the coupler system of the present invention, which is for connecting elongate, horizontally disposed rods 12 to vertical supports, such as vertical support 14, which includes a top region 16. Coupler system 10 includes a top-cap component 18 for attaching to top region 16 of vertical support 14. Top-cap component 18 includes a body 20 with plural cavities 22 formed therein. Body 20 is preferably formed with beveled edges 23 that define plural cavities 22. Coupler system 10 also includes at least one ball-cap component 24 for attaching to an end of rod 12. Ball-cap component 24 includes a ball region 26 that is constructed to fit within one of plural cavities 22 of top-cap component 18. In addition to ball region 26, ball-cap component 24 also includes a neck region 28, and an angled region 30 located adjacent neck region 28 and away from ball region 26. Each of cavities 22 is formed with an elongate channel 31 for allowing neck regions 28 of ball-cap components 24 to extend therethrough.

Figure 2:
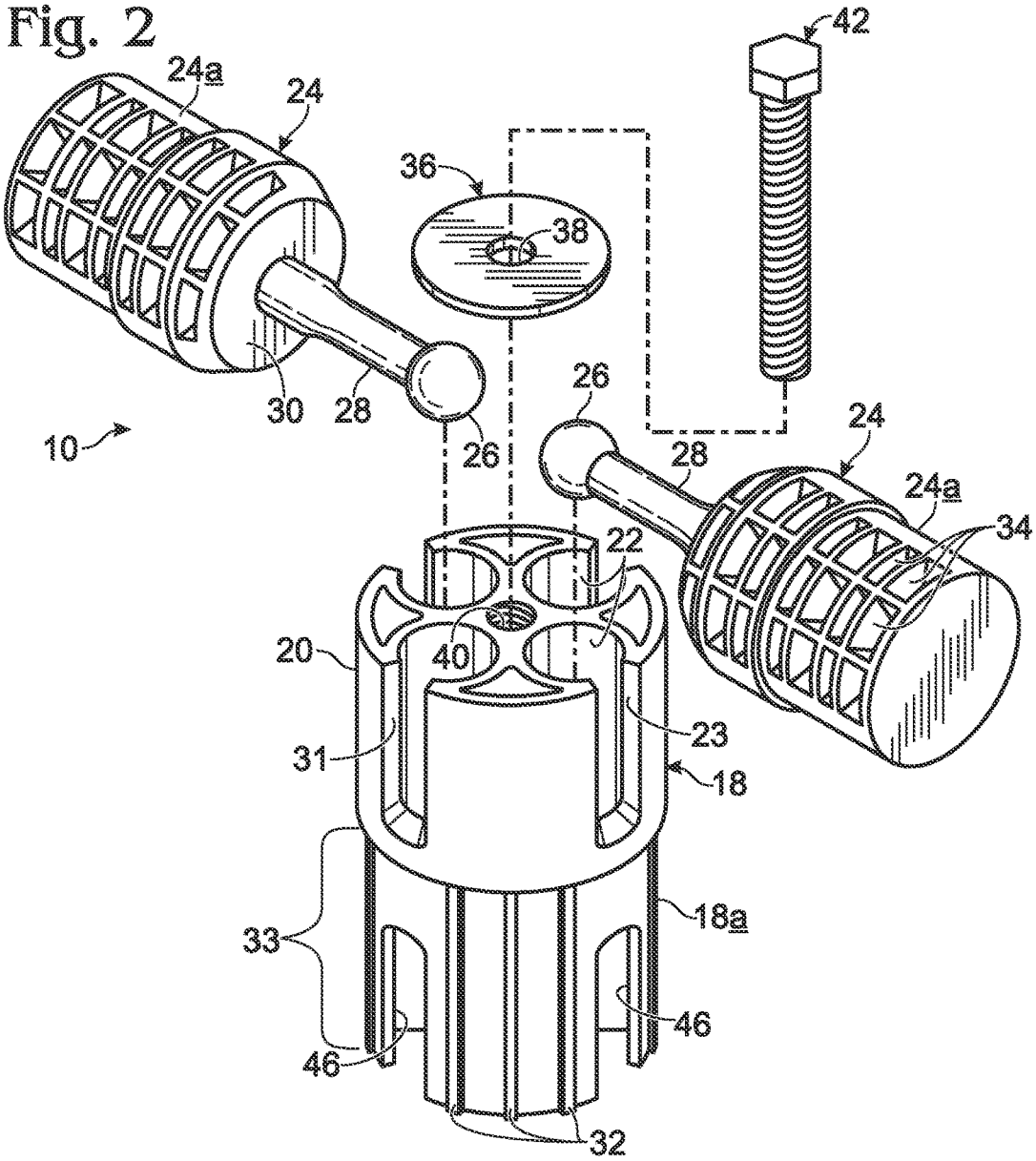
FIG. 2 is an exploded view of part of the coupler system shown in FIG. 1, without illustrating the vertical support and rods.

Referring to FIGS. 1 and 2, top-cap component 18 and ball-cap components 24 include corresponding insertion regions 18*a* and 24*a*. Those regions are preferably reinforced by forming them with plural ribs, such as those depicted at 32 on insertion region 18*a*, that have a length dimension 33 that tends to maintain the structural integrity of the coupler system. Referring to insertion region 24*a*, those regions can also be reinforced by forming the region with plural cavities 34 to form a honey-comb-like construction that provides strength, flex, and reduces materials cost.

With respect to materials, ball and neck regions 26, 28 are preferably constructed from metal or high strength, fiber-reinforced plastic. The metal may be rolled or hardened steel. The plastic is preferably fiber-reinforced nylon products that are commercially available from Clariant Chemical Corporation. Angled region 30 is preferably constructed from the same reinforced plastic. In general, top-cap and ball-cap components 18, 24 are preferably constructed from materials that have the following features: (i) maintain ball regions in corresponding cavities under forces of about 2,000 lbs/in$^2$; (ii) have memory so that ball regions return substantially to an original position after an application of force is removed.

Ball and neck regions 26 and 28 are preferably about 1⅛" to 1¼" in length. While shown at an angle of about 90 degrees from neck region 28, angled region 30 could be at any suitable angle, such as an angle that is greater than 90 degrees. Region 30 is preferably formed of plastic and the neck extends into the angled region either by forming the plastic around the neck, or by drilling an opening in the angled region that is sized to frictionally fit the neck portion in it.

Referring again to FIGS. 1-2, body 20 of top-cap component 18 is preferably formed with four cavities 22, each having substantially the same shape, and each for accepting ball region 26 of ball-cap components 24. Coupler system 10 also includes a cover component 36 which can be placed over, and fastened to, the top of top-cap component 18 after ball regions 26 have been placed in cavities 22. Cover component 36 is formed with a central opening 38 that can be aligned with central, threaded opening 40 of top-cap component 18 so that a fastener such as bolt 42 can be placed through the openings and driven into opening 40.

Referring to FIG. 1, vertical support 14 may be formed with plural slots 44, shown by dashed lines, adjacent the top of the support. Those slots are formed to receive conventional hooks (undepicted) that are fitted into the ends of rods, like rods 12, for attaching to the vertical support. Referring to FIG. 2, insertion region 18*a* of top-cap component 18 may be formed with U-shaped openings 46 so that top-cap component 18 can be used with conventional, so-called hook-and-slot systems.

Figure 3:
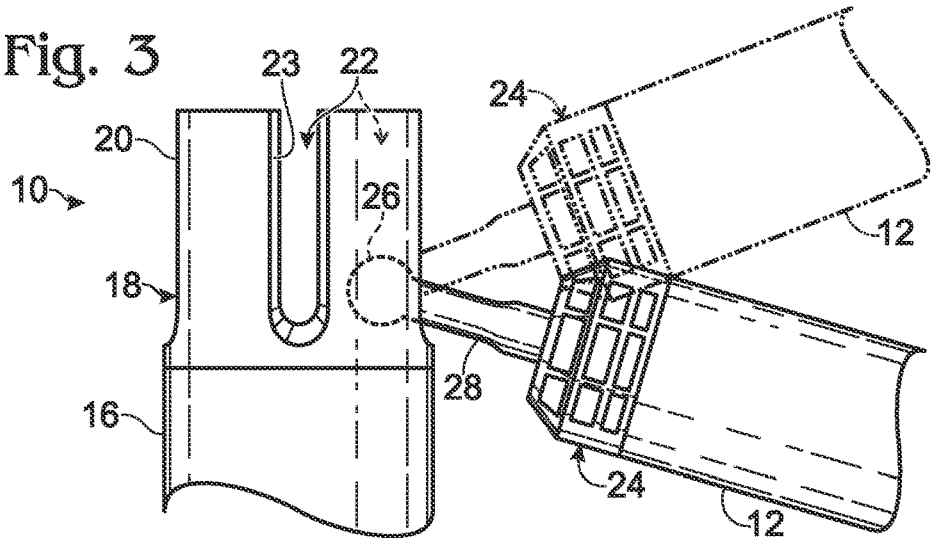
FIG. 3 is a fragmentary, side view of the top-cap component and one of the opposing ball-cap components shown in FIG. 1, illustrating the interaction between those two components.

Referring to FIG. 3, coupler system 10 is shown with top-cap-component 18 being inserted into a vertical support 16, and one of ball-cap components 24 being inserted into a rod 12. That rod can be positioned at various angles relative to top-cap component 18/vertical support 16 as shown by the positions in dot-dashed lines and in solid lines. Ball region 26 can be fitted into a corresponding cavity of top-cap component 18 so that the rod is suitably supported in a horizontal position. As illustrated in FIG. 3, the ball cap provides a curved surface that is received in the cavity of the top cap component. This curved-surface attachment region is retained in the cavity, and its curved shape allows for rotation of the neck and pole relative to the vertical support. Using the invention, this fitting of ball region 26 into a corresponding cavity of top-cap component can be accomplished from various angles, such as those shown in FIG. 3, which are approximately in the range of 75-105 degrees relative to the top-cap component 18/vertical support 16. Various, more extreme angles could be in the range of about 30-150 degrees, depending upon the relative sizes of the ball-cap component and the top-cap component/vertical support.

The top-cap, or socket, component is inserted into the top of a vertical support or tube and is fastened in place such as by riveting. It preferably includes four cavities, or sockets, having beveled edges that aid in fitting a ball region of a ball-cap component into one of the cavities, and are otherwise shaped as shown in the figures. The top-cap component and ball-cap components can be molded to fit into existing, industry-standard-sized poles or tubes.

To mount a horizontal tube with opposing ball-cap components between a pair of vertical poles or tubes with top-cap components, the user elevates a ball-cap component to rest on the top of the top-cap component above a cavity. The ball region of the ball-cap component will fall by gravity into the base of the cavity, and that cavity receives the ball and provides for full rotation of the ball within the socket, thereby allowing for a variety of angles at which the horizontal tube may be hung between two vertical support poles, while maintaining stability.

All of the Figures together with the above-identified description can be combined with the following further description of features of the invention for a better understanding of those features.

Articulation/Ease of Access Features

- Beveled edging along the edges of the socket
- Beveled/angled region adjacent each ball, and on the length of the neck of the ball
  - All beveling on the ball and socket portions allows for a greater range of rotation/adjustability of the ball relative to the socket Reinforcement/Structural Integrity Features

- Opposing sets of ribs on members inserted into tubes that offer structural support
- The length of the ribbed members extending into the tubes also helps maintain structural integrity
- Plastic material is designed to keep ball in socket under about 2,000 lbs/in$^2$ of force
- Plastic material is designed to have memory so that the ball returns to the original position after the application of the force is removed Retrofitability Features

- There are two ways to secure the ball portion and the socket portion to existing tubes—(a) pop rivet or (b) screw (through boss)
- Friction also helps keep each portion secured into existing tubes In operation, top-cap component 18 is inserted into an "upright" or vertical pole of various constructions and is riveted into place. This piece, with its multiple cavities/sockets is used as a receptacle for a variety of horizontal supports. Being made of plastic, the end-cap component is less likely to become damaged during normal use, as well as eliminating the normal "shredding" of the upright by the metal hook used in conventional systems. The depth of the socket allows for stable coupling with corresponding ball regions of ball-cap components 24. The socket also allows full articulation of the ball-cap component achieving a variety of angles between any two vertical poles while remaining stable. The top-cap component includes a ¼-20 threaded standard brass insert at the center of its apex to allow a variety of decorative and functional accessories to be attached to the crown in a safe and stable manner. The top-cap component is also molded to accommodate conventional hook and slot equipment as well, so that the coupler system may be used with conventional hook and slot products.

Ball-cap component 24 is inserted into a rod or tube, such as a telescoping one, and is secured to the tube with a pop rivet. The ball-cap component is inserted into opposing ends of the telescoping tube, and sized to frictionally fit within the corresponding inside diameters of that tube. As noted above, ball-cap component 24 is preferably constructed of high-strength plastic infused with glass fibers for rigidity. Once ball-cap components are attached to the ends of the telescoping tube, the tube can be mounted horizontally, as described above, between two upright or vertical poles that are fitted with the top-cap component.

The disclosure set forth above encompasses multiple distinct inventions with independent utility. While each of these inventions has been disclosed in a preferred form or method, the specific alternatives, embodiments, and/or methods thereof as disclosed herein are not to be considered in a limiting sense, as numerous variations are possible. The present disclosure includes all novel and non-obvious combinations and subcombinations of the various elements, features, functions, properties, methods and/or steps disclosed herein. Similarly, where any disclosure above recites "a" or "a first" element, step of a method, or the equivalent thereof, such disclosure should be understood to include one or more such elements or steps, neither requiring nor excluding two or more such elements or steps.

Inventions embodied in various combinations and subcombinations of features, functions, elements, properties, steps and/or methods may be recited in claims of a related application. Such claims, whether they focus on a different invention or the same invention, and whether different, broader, narrower, or equal in scope to the original claims, are also regarded as included within the subject matter of the present disclosure.

What is claimed:

1. A drape-and-rod coupler system for connecting elongate, horizontally disposed poles to vertical supports, comprising:

a top-cap component for attaching to the top of one of the vertical supports, including a body with plural sidewalls and plural cavities, and wherein each cavity is formed by adjacent sidewalls with each cavity having an integral top region that is open, an integral bottom region, and with an elongate channel that terminates above the bottom region and has a width;

at least one ball-cap curved-surface component for attaching to an end of one of the poles, and including a spherically-shaped ball curved-surface attachment region coupled to a rigid cylindrical neck so that rotation of the ball curved-surface attachment region results in angular movement of the neck, with the ball curved-surface attachment region having a diameter dimension larger than the neck that exceeds the width of the channel but also allows the ball to fit within one of the plural cavities of the top-cap component and retains the curved-surface attachment region within the cavity;

wherein the at least one ball-cap curved-surface component and the top-cap component are constructed to allow the ball-cap curved-surface component to be received into a corresponding cavity, via the open, top region of the cavity, and to be held in the cavity by the combination of the ball diameter dimension of the curved-surface attachment region larger than the neck, the channel, width and the integral bottom region; and wherein the top-cap and curved-surface components are constructed from material that is designed to have memory so that the ball curved-surface attachment region returns to the original position after an application of force is removed.

2. The coupler system of claim 1, wherein each of the plural cavities in the body of the top-cap component is formed with beveled edges.

3. The coupler system of claim 2, wherein the body is formed with four cavities, each for accepting a curved-surface attachment region of the curved-surface component.

4. The coupler system of claim 3, wherein each of the cavities has substantially the same shape.

5. The coupler system of claim 3, further including a cover component, and wherein a central hole is formed in the body for receiving a fastener that secures the cover component to the top-cap component.

6. The coupler system of claim 1, wherein the curved-surface component includes a ball and an angled region located adjacent the neck and away from the ball.

7. The coupler system of claim 1, wherein the top-cap and curved-surface components include insertion regions with opposing sets of ribs.

8. The coupler system of claim 7, wherein the ribs are constructed with a length dimension that tends to maintain structural integrity of the coupler system.

9. The coupler system of claim 1, wherein the curved-surface attachment region and the neck are constructed from metal, and the angled region is constructed from reinforced plastic.

10. The coupler system of claim 1, wherein the top-cap and curved-surface components are constructed from material that is designed to maintain the curved-surface attachment region in the corresponding cavity under forces of about 2,000 $lbs/in^2$.

11. The coupler system of claim 1, wherein the curved-surface attachment region of the curved-surface component and the cavity of the top-cap component allow fitting the curved-surface component into the cavity at an angle within a range of about 75-105 degrees relative to the top-cap component.

12. The coupler system of claim 1, wherein the curved-surface attachment region of the curved-surface component and the cavity of the top-cap component allow fitting the curved-surface component into the cavity at an angle within a range of about 30-150 degrees relative to the top-cap component.

13. The coupler system of claim 1, wherein the curved-surface attachment region of the curved-surface component is a substantially spherical ball.

* * * * *